US006641619B1

(12) United States Patent
Nobuto et al.

(10) Patent No.: US 6,641,619 B1
(45) Date of Patent: Nov. 4, 2003

(54) OIL TONE ARTIFICIAL LEATHER SHEET

(75) Inventors: Yoshiki Nobuto, Okayama-Pref. (JP); Hisao Yoneda, Okayama-Pref. (JP); Kohei Hayashi, Okayama-Pref. (JP)

(73) Assignee: Kuraray Co., Ltd., Kurashiki (JP)

( * ) Notice: Subject to any disclaimer, the term of this patent is extended or adjusted under 35 U.S.C. 154(b) by 353 days.

(21) Appl. No.: 09/639,107

(22) Filed: Aug. 16, 2000

(30) Foreign Application Priority Data

Aug. 23, 1999 (JP) ..... 11-235341

(51) Int. Cl.[7] ..... D06M 11/00

(52) U.S. Cl. ..... 8/115.6; 8/115.51; 8/115.54; 8/115.55; 8/115.7; 8/116.5; 8/120; 428/29; 428/96; 428/151; 428/156; 428/171

(58) Field of Search ..... 8/115.51, 115.6, 8/115.7, 116.5, 120, 115.54, 115.55; 428/290, 151, 96, 156, 171

(56) References Cited

U.S. PATENT DOCUMENTS 3,673,059 A * 6/1972 Brandt ..... 161/88
4,143,198 A * 3/1979 Sinn et al. ..... 428/290
5,503,899 A 4/1996 Ashida et al.
5,876,466 A 3/1999 Nakashima et al.

FOREIGN PATENT DOCUMENTS

JP 401033283 A * 2/1989 ..... D06N/3/14

* cited by examiner

*Primary Examiner*—Yogendra N. Gupta
*Assistant Examiner*—Derrick G Hamlin
(74) *Attorney, Agent, or Firm*—Oblon, Spivak, McClelland, Maier & Neustadt, P.C.

(57) ABSTRACT

An oil tone artificial leather sheet having a blend of an oily substance of viscosity 50–10,000 mPa·s at 30° C. and a supporting polymer on part or all of a nap surface of a napped sheet comprising a non-woven fabric of microfine fibers and polyurethane existing in the non-woven fabric, wherein raised fibers comprising the microfine fibers are present in part or all of at least one surface and are forming the nap surface, and which has a high-quality appearance, and the soft hand touch and touch of natural leather. The sheet is useful in, for example, the manufacture of shoes or the like.

12 Claims, No Drawings

OIL TONE ARTIFICIAL LEATHER SHEET

BACKGROUND OF THE INVENTION

1. Field of the Invention

The present invention relates to an oil tone artificial leather sheet which has a high-quality appearance, has a soft hand touch and feel equivalent to that of natural leather, and is useful in application to the manufacture of shoes, etc.

2. Description of the Background

Recently, as outdoor activities are assuming more importance as a form of recreation, shoes providing a casual feel and made of natural leather or man-made leather are becoming more popular. Oil tone materials like natural leather have a moist touch and an elegant appearance, and are in high demand for high-quality materials for shoes.

Artificial leather is also used for shoes on account of its light weightness as compared with natural leather, but due to its structure, it requires a certain surface preparation in order to give it a moist touch like the oil tone material of natural leather.

In the past, various treatments have been proposed as surface coating agents not only for artificial leather but also for synthetic leather. For example, Japanese Patent Laid-Open No. 285268/1986 discloses a method using a surface coating agent comprising a blend of polybutylene and silica with a resin having a polyurethane as its main component. Further, Japanese Patent Laid-Open No. 139877/1989 discloses a method of containing an oil-soluble surfactant in such a substance. However, in these methods, although surface touch is improved, the moist touch of oil tone natural leather cannot be reproduced.

Accordingly, there remains a need for artificial leather material which overcome these drawbacks.

SUMMARY OF THE INVENTION

It is an object of the present invention to provide a an oil tone artificial leather sheet.

After intensive studies of artificial leather sheets which had a high-quality appearance and the moist touch of oil tone natural leather, the inventors succeeded in developing an oil tone artificial leather sheet having a blend of an oily substance of viscosity 50–10,000 mPa·s at 30° C. and a supporting polymer on part or all of, i.e., on at least a portion of, a nap surface of a napped sheet comprising a non-woven fabric of microfine fibers and polyurethane existing in the non-woven fabric, wherein raised fibers comprising said microfine fibers are present in part or all of at least, i.e., at least a portion of, one surf ace and are forming the nap surface, and thereby achieved the above object.

Accordingly, the present invention provides an oil tone artificial leather sheet, comprising:

- a napped sheet comprising a non-woven fabric of microfine fibers and a polyurethane in the non-woven fabric, wherein raised fibers comprising the microfine fibers are present in at least a portion of at least one surface of the sheet and form the nap surface; and
- a blend of an oily substance having a viscosity of 50 to 10,000 mPa·s at 30° C. and a supporting polymer on at least a portion of the nap surface of the napped sheet.

The present invention also provides a method of making the oil tone artificial leather sheet comprising coating the napped sheet with the blend of the oily substance and the supporting polymer.

DETAILED DESCRIPTION OF THE INVENTION

A more complete appreciation of the invention and many of the attendant advantages thereof will be readily obtained as the same becomes better understood by reference to the following detailed description.

In the present invention, it is particularly desirable that the supporting polymer is an olefinic elastomer or a vinyl aromatic elastomer. Suitable examples of olefinic elastomers are block copolymers comprising an ethylene polymer or an ethylene polymer block having hydrocarbon groups with 18 carbon atoms in side chains, and 5–60 mol % of units having side chains relative to the ethylene unit forming the main chain. Suitable examples of vinyl aromatic elastomers are block copolymers comprising a polymer block A comprising a vinyl aromatic compound and a polymer block B comprising a diene, or their hydrogenation products. The weight ratio of oily substance to that of the supporting polymer is preferably in the range 1:1–20:1. This range includes all specific values and subranges therebetween, such as 2:1, 5:1, 10:1, 12:1, 15:1, and 18:1.

The supporting polymer of the oily substance comprising this invention is a polymer having elastomeric properties at ordinary temperature, which, when made into a sheet of 0.5mm thickness, easily lengthens by 100% or more at ordinary temperature under an external force, but immediately recovers its original shape when the force is removed. When a powder of this polymeric elastomer is immersed in the oily substance used in conjunction with it, left for 24 hours at ordinary temperature and then subjected to natural filtration, the weight of the powder absorbs the oily substance so that it increases to 200% or more. Good results are obtained when an olefinic elastomer or a vinyl aromatic elastomer is used as the supporting polymer. Examples of such olefinic elastomers are block copolymers comprising an ethylene polymer or an ethylene polymer block having hydrocarbon groups with 1–8 carbon atoms in side chains, and 5–60 mol % of units having side chains relative to the ethylene unit forming the main chain. Examples of vinyl aromatic copolymers are block copolymers comprising a polymer block A comprising a vinyl aromatic compound and a polymer block B comprising a diene compound, or a hydrogenated block hydrogenation product obtained by hydrogenation of this block copolymer. With these supporting polymers, particularly good results are obtained from the viewpoint of retention of the oily substance.

The olefinic elastomer which is a suitable example of a supporting polymer useful in this invention will be described below.

An olefinic elastomer is a resin based on a hydrocarbon chain, and it has a segment having a glass transition point below room temperature. Examples are EPR (ethylene propylene rubber), EBR (ethylene butylene rubber) and HBR (hydrogenated butadiene rubber). The manufacturing method f or these polymers, which is well-known, requires an olefin such as ethylene, propylene, butene or octene as the main raw monomer, and if necessary, a cyclic hydrocarbon compound or diene hydrocarbon compound such as isobutylene, cyclopropene, cyclobutene, cyclopentene, cyclooctene, cyclooctadiene, butadiene, isoprene or norbornene used in conjunction. These monomers are suitably blended, and polymerization carried out by a known polymerization technique, for example, radical polymerization, anionic polymerization or cationic polymerization. Hydrogenation may be performed in some cases to enhance final physical properties, especially weatherability.

A particularly good olefinic elastomer is a copolymer of ethylene and an alpha-olefin. Examples of the alpha-olefin are propylene, butene, pentene, hexene, heptene, octene and nonene. There is no particular limitation on the polymerization method, but polymerization is usually performed in the presence of a Zieglar-Natta catalyst or a metallocene catalyst. In this case, ethylene polymers having 5–60 mol % of units containing a side chain derived from the alpha-olefin relative to the ethylene unit forming the main chain, have excellent elastomer properties and oily substance retention. There is no limitation on the molecular weight of the olefinic elastomer, but it is in the range of several 10,000 to several 100,000. Also, other monomers apart from alpha-olefins may be copolymerized in small amounts as desired. Examples of such monomers are styrene, butadiene and isobutylene, etc.

Next, the vinyl aromatic elastomer which is a suitable example of the supporting polymer comprising this invention, will be described below. Typical examples of the vinyl aromatic elastomer are polymers which generally have a styrene unit as a hard segment, and a resin part with a glass transition point below room temperature as a soft segment. The resins known as SBS (triblock copolymer comprising a styrene polymer block butadiene-polymer block-styrene polymer block), SEBS (triblock copolymer comprising a styrene polymer block-ethylene/butadiene copolymer block-styrene polymer block), and SEPS (triblock copolymer comprising a styrene polymer block-ethylene/propylene copolymer block-styrene polymer block), may generally be used as suitable block copolymers.

A block copolymer which is a particularly suitable vinyl aromatic elastomer, or the block copolymer used as the base for its hydrogenated block copolymer, will now be described below.

There is no particular limitation on the number of the polymer blocks A and polymer blocks B in the block copolymer. Herein, if polymer block A is represented as A and polymer block B is represented as B, suitable configurations of block polymers are given by the structural formulae A-B, (A-B)n, (A-B)n-A, (B-A)n-B (where n is an integer from 1–10), and (A-B)mX (X is a coupling agent residue combining with (A-B) units where m is an integer from 2–15). The triblock copolymer represented by A-B-A is especially desirable in respect of oily substance retention characteristics. In the block copolymer, it is preferable from the viewpoint of oily substance retention characteristics that the content of the vinyl aromatic compound is 5–75 weight %, and more preferable that it is 10–65 weight %.

The vinyl aromatic compound comprising the polymer block A in the block copolymer may for example be styrene, alpha-methyl styrene, o-, m- or p-methyl styrene, 1, 3-dimethyl styrene, vinyl naphthalene or vinyl anthracene. Of these, styrene or alpha-methyl styrene are desirable in respect of plasticity. One of these vinyl aromatic compounds may be used alone, or two or more may be used together.

The conjugated diene comprising the polymer block B in the block copolymer may for example be 1,3-butadiene, isoprene, 2,3-dimethyl-1,3-butadiene, 1,3-pentadiene, or 1,3-hexadiene. Of these, isoprene or 1,3-butadiene, or their mixtures, are desirable in respect of plasticity. One of these conjugated dienes may be used alone, or two or more may be used together.

Apart from the fact that the structure of the polymer block B in the block copolymer comprises a conjugated diene, there is no particular limitation on the structure, nor on the amount of 1, 2-bonds and 3, 4-bonds.

There is no particular limitation on the number average molecular weight of the block copolymer, but it is preferably in the range 50,000–500,000 and more preferably in the range 100,000–400,000. These ranges include all specific values and subranges therebetween, such as 75,000, 150, 000, 200,000, 300,000 and 450,000. If it is less than 50,000, oily substance retention declines, and if it exceeds 500,000, plasticity declines.

Such block copolymers are well-known in the art, and may for example be manufactured by the following well-known anionic polymerization technique. Specifically, a vinyl aromatic compound and a conjugated diene are polymerized to form a block copolymer in an inert organic solvent such as n-hexane or cyclohexane, using an alkyl-lithium compound or the like as an initiator. In this case, coupling agents, such as a dichloromethane, carbon tetrachloride or tetrachlorosilane, may also be used if desired.

When the block copolymer is a hydrogenation product of the above-mentioned block copolymer, hydrogenation may be performed to give a hydrogenated block copolymer in the presence of a hydrogenation catalyst in an inert organic solvent, according to well-known procedures.

In this invention, when the aforesaid block copolymer or the hydrogenated block copolymer, which is the hydrogenation product of the above-mentioned block copolymer, is used as a supporting polymer, the hydrogenated block copolymer is more preferable from the viewpoints of heat resistance and weatherability, and it is desirable that 70% or more of the carbon-carbon double bonds originating from the conjugated diene in the block copolymer before hydrogenation, are hydrogenated. The amount of carbon-carbon double bonds in the polymer block B in the hydrogenation block copolymer can be determined by iodine value measurement, infrared spectrophotometry or nuclear magnetic resonance, etc. It should be understood that, in addition to the aforesaid two kinds of blocks, other monomers can be copolymerized in blockwise or random fashion to the extent that they do not have an adverse effect on the invention. In addition, styrene rubbers such as SBR (styrene butadiene rubber) can also be included in the styrene elastomers besides the block copolymer described above.

As regards the resin comprising the supporting polymer used by this invention, functional groups such as carboxyl groups, hydroxyl groups, acid anhydride groups, amino groups and epoxy groups may be contained in or at the end of the molecular chain to the extent that they do not adversely impact the object of this invention.

The oily substance blended with this supporting polymer is an oily substance having a viscosity of 50–10,000 mPa·s at 30° C., and which practically has no miscibility with water so that it forms a separate phase at ordinary temperature. This range for the viscosity of the oily substance includes all specific values and subranges therebetween, such as 75, 100, 250, 500, 1,000, 2,000, 5,000 and 7,500 mPa·s at 30° C. When the viscosity is less than 50 mPa·s, there is a marked migration of the oily component after applying to the nap surface, and there is a marked change in the oily hand touch of the surface with time. When the viscosity exceeds 10,000 mPa·s, the oily substance does not blend with the supporting polymer so that the oily hand touch is weak making it unfit for the present purpose.

Specific examples of the oily substance are paraffin type or naphthene type process oils, white oil, mineral oil, oligomers of ethylene and alpha-olefins, paraffin wax, flow paraffins, silicone oil, vegetable oil and aromatic oils, these being used separately or in admixture. Of these, paraffin process oils are particularly desirable.

According to this invention, the weight ratio of the supporting polymer (1) and oily substance (2) is preferably in the range (2)/(1)=1–20. This range includes all specific values and subranges therebetween, such as 2, 5, 10, 12, 15, and 18. When this weight ratio is less than 1, a moist, oily hand touch is not apparent, and when it exceeds 20, the oily substance starts to bleed and the appearance of the oil tone artificial leather sheet changes with time which is undesirable. It is more preferable that the ratio (2)/(1) is in the range 3–12.

According to this invention, by changing the type and molecular weight of the supporting polymer (1), the type of the oily substance (2) and weight ratio when two or more oily substances are used together, the proportion of (2)/(1) and the coating amount on the surface, it is possible to render any hand touch from oily to waxy as found in oil tone natural leather materials.

Next, the napped sheet used in this invention and comprising an entangled non-woven fabric of microfine fibers and polyurethane contained in the non-woven fabric, wherein a nap of these microfine fibers is present on part or all of at least one surface, will be described below.

This sheet comprises a non-woven fabric comprising microfine fibers not exceeding 0.3 denier, and a polyurethane contained in the non-woven fabric. The average fineness of the fibers comprising the sheet must not exceed 0.3 denier, and preferably lies in the range 0.1–0.0001 denier. If the fineness exceeds 0.3 denier. the nap surface feels rough, and the appearance is poorer. If the fineness is less than 0.0001 denier, the tensile strength of the fibers decreases, the peeling strength and shear strength of the layers decreases, and full color-developing properties are not obtained.

To manufacture the microfine fibers, a typical method is to first obtain microfine fiber-forming fibers by mix spinning or composite spinning, using two or more polymers which are immiscible in the molten state and have different dissolution or decomposition properties, by producing sea-island fibers, or by producing divided composite fibers by composite spinning, and then removing part (for example, the sea component) by extraction or decomposition, or alternatively peeling away the polymer interface of the divided composite fibers. In addition to these methods, the melt blow method may also be used, for example, wherein a fiber-forming polymer is discharged from a melt spinning nozzle, and a gas is immediately blown over at high speed so as to obtain fine fibers. However, from the viewpoint, of management of fiber thickness and microfine fiber stability, it is preferable to first form the aforesaid microfine fiber-forming fibers.

There is no particular limitation on the resin comprising the microfine fibers, examples being aromatic polyesters such as polyethylene terephthalate, polybutylene terephthalate, polyethylene naphthalate and copolymer polyesters having these as main components, polyamides such as Nylon-6, Nylon-66 and Nylon-610, and polyolefins such as polyethylene and polypropylene. Of these, aromatic polyesters and polyamides are preferable as they give an artificial leather with the aspect of natural leather, and have excellent color-developing properties. Pigments such as carbon black and coloring agents such as dyes may also be added to the extent that they do not adversely affect stability during spinning.

The resin component comprising the microfine fiber-forming fibers which is extracted or decomposed, is at least one type of polymer chosen from polyethylene, polypropylene, ethylene-propylene copolymer, ethylene-vinyl acetate copolymer, polystyrene, styrene-acryl monomer copolymer, styrene-ethylene copolymer, and copolymer polyesters. Of these, polyethylene, polystyrene or copolymers having these as their main component, are preferable from the viewpoint of ease of extraction.

Next, the method of forming the entangled non-woven fabric comprising polyurethane using the aforesaid microfine fibers or microfine fiber-forming fibers may be any of the well-known methods, and may be achieved, for example, by successively performing a step for manufacturing an entangled non-woven fabric from the microfine fiber-forming fibers, a step for impregnating the non-woven fabric with polyurethane solution and coagulating the polyurethane, and a step for denaturing the microfine fiber-forming fibers to microfine fibers. It will be appreciated that the step for denaturing to microfine fibers and the step for impregnating/coagulating polyurethane may be reversed.

A typical method of manufacturing the non-woven fabric using the microfine fiber-forming fiber, is to form an original fiber by spinning, drawing, thermal setting, crimping and cutting the microfine fiber-forming fiber according to the prior art technique, opening this original fiber with a card, forming random or cross-lap webs with a webber, and laminating the webs obtained as required to give a desired weight. Herein, the weight of the webs is suitably chosen according to the intended use, but in general, it is preferably within the range of 100–3,000 g/m$^2$. To reduce costs, two substrates may be efficiently manufactured in one operation by impregnating/coagulating about twice the required weight of non-woven fabric with a polyurethane solution, and slicing in the thickness direction with a band knife or the like.

The laminated webs are then subjected to a known entangling treatment such as needle pun, ching, water jet entanglement or the like to be converted to a fiber-entangled non-woven fabric. The number of needle punches and the needle punching conditions depend on the shape of the needle used and thickness of the webs, but in general this may be set to 200–2,500 punches/cm$^2$.

If necessary, the surface of the entangled non-woven fabric may be smoothed by a known method such as a thermal press before incorporating the polyurethane. In sea-island fibers wherein, for example, polyethylene is the sea component, and a polyester or polyamide is the fine island component, a non-woven fabric with excellent surface smoothness may be obtained by melt adhesion of the polyethylene, which is the sea component, and causing the fibers to adhere to each other by using a thermal press. In the case of sea-island fibers which cannot be denatured to microfine fibers by dissolving away one component of the fibers forming the nonwoven fabric, to prevent a hard hand touch from developing when the polyurethane which is to be incorporated is fixed to the fibers, it is desirable that the fiber surface is covered with a temporary filling agent such as polyvinyl alcohol before impregnation with polyurethane, the polyurethane then applied, and the temporary filling agent then removed. Even in the case of sea-island fibers which allow manufacture of microfine fibers by dissolving away or decomposing one component, a more flexible sheet can be obtained by applying the aforesaid temporary filling agent to cover the surface of the sea-island component fiber when the non-woven fabric is formed.

Next, from the viewpoint of hand touch, the resin incorporated in the non-woven fabric is a polyurethane resin. Suitable examples of the polyurethane resin are segmented polyurethanes which may be derived using at least one type of polymer of number average molecular weight 500–5,000 chosen from the group: polyester diols obtained by reacting diols with dicarboxylic acids or their ester-forming derivatives, polylactone diols, polycarbonrate diols, polyether diols and polyether ester diols as a soft segment, and reacting it with a di-isocyanate compound and low molecular weight chain extending agent. The range for the number average molecular weight of this polymer includes all specific values and subranges therebetween, such as 1,000, 2,000, 3,000 and 4,000.

From the viewpoint of durability and hand touch of the artificial leather, the diol compound used to synthesize the aforesaid polyester diol forming the soft segment is preferably an aliphatic compound having from six to ten carbon atoms, for example, 3-methyl-1,5 pentanediol, 1,6-hexane diol, 2-methyl-1,8-octanediol, 1,9-nonanediol and 1,10-decanediol Typical examples of the dicarboxylic acid are aliphatic dicarboxylic acids such as succinic acid, glutaric acid, adipic acid, azelaic acid and sebaccic acid, or aromatic dicarboxylic acids such as terephthalic acid and isophthalic acid.

When the average molecular weight of the polymer diol is less than 500, the product does not have sufficient flexibility and the hand touch of natural leather is not obtained, making it unfit f or the present purpose. On the other hand, when the average molecular weight of the polymer diol is greater than 5,000, as the concentration of urethane groups decreases, a balanced artificial leather sheet with regard to flexibility, durability, heat resistance and hydrolysis resistance is difficult to obtain. The di-isocyanate compound may be an aromatic, aliphatic or alicyclic diisocyanate such as 4,4'-diphenylmethane di-isocyanate, xylene diisocyanate, toluene di-isocyanate, isophorone di-isocyanate, dicyclohexanemethane-4,4'-di-isocyanate and hexamethylene di-isocyanate.

The low molecular weight chain extending agent may be a compound having a low molecular weight not exceeding 300 and comprising two active hydrogen atoms, for example ethylene glycol, propylene glycol, butane diol, hexane diol, N-methyldiethanolamine, ethylene diamine, diaminodiphenylmethane, diaminodicyclohexylmethane and isophorone diamine.

The method of synthesizing the polyurethane may be the one shot method or the prepolymer method.

If necessary, coagulation regulators and stabilizers may also be added to the polyurethane, and other polymers may also be used in conjunction. Further, coloring agents such as carbon black or dyes can also be added.

There is no particular limitation on the method of incorporating the polyurethane in the non-woven fabric, but from the viewpoint of balanced hand touch, it is desirable if the polyurethane solution is directly impregnated in the non-woven fabric and the fabric squeezed in a mangle if necessary, or allowing the polyurethane solution to sink in while applying it with a coater. The impregnated polyurethane solution may be incorporated in the non-woven fabric by wet coagulation or dry coagulation, but wet coagulation is to be preferred as the hand touch and feel of natural leather is obtained. The polyurethane may also be used in the form of an emulsion. From the viewpoint of achieving the flexibility of natural leather, it is preferable that the weight ratio of microfine fibers and polyurethane forming the sheet lies in the range 30/70–80/20, and more preferable if it lies in the range 35/65–55145. These ranges include all specific values and subranges therebetween, such as 40/60, 45/55, 50/50, 60/40, 70/30 and 75/25. If the ratio of fiber is too low, the artificial leather sheet becomes rubber-like which is undesirable, whereas if the ratio of fiber is too high, it becomes paper-like so that the desired natural leather hand touch is not obtained.

If sea-island fibers are used as the microfine fiber-forming fibers, after the polyurethane is incorporated in the non-woven fabric, the microfine fiber-forming fibers are transformed into microfine fiber bundles by treating the fabric with a liquid which is not a solvent for the polyurethane and island component of the microfine fiber-forming fiber, but which functions as a solvent or decomposing agent with respect to the sea component of the microfine fiber-forming fiber, thereby forming a sheet of microfine fiber non-woven fabric and polyurethane. It is of course possible to form a sheet using a method to transform the microfine fiber-forming fibers into microfine fiber bundles before incorporating the polyurethane. Also, when using divided composite fibers with peeling properties, a method can be used to form the microfine fiber bundles by peeling away at the fiber polymer interface using a liquid which promotes peeling.

The raising of the fibers in the sheet comprising the microfine fiber non-woven fabric and polyurethane so obtained can be performed by a known method such as buffing or brushing, etc. As the length of the raised fibers affects the appearance or the appearance after the supporting polymer containing the oily substance is applied, the fiber length is adjusted by selecting, for example, the number of the sandpaper used for buffing, or the sanding speed and pressure. The raised fibers may be present on all of one surface of the sheet, on all of both surfaces of the sheet, or as spots in parts of one surface or both surfaces.

According to this invention, the blend comprising the oily substance and supporting polymer is coated or impregnated so that it is present on at least part of the napped surface of the sheet.

In the case of coating, a method known in the art may be used such as, for example, hot melt coating where the blend is melted by heat, or coating of a composition, obtained by dissolving the oily substance and supporting polymer in a common solvent, using a gravure roll, spray or direct coating. Gravure coating is the preferred method. When a gravure roll is used, 55–200 mesh is suitable. A suitable coating amount is 1–50 g of composition per 1 $m^2$ of sheet surface. This range includes all specific values and subranges therebetween, such as 2, 5, 10, 15, 20, 25, 30, and 40 g of composition per 1 $m^2$ of sheet surface. When the composition contains a solvent, the coating amount referred to herein is the total amount of oily substance and supporting polymer excluding the solvent. When the coating amount is less than 1 $g/m^2$, the oily hand touch is lacking, and when it exceeds 50 $g/m^2$, the feeling of nap is lost and the hand touch becomes harder. It should be noted that, according to this invention, the aforesaid composition is coated on the napped surfaces, but it is undesirable if all the raised fibers are coated with the composition so that there are effectively no longer any fiber on the surface.

In the oil tone artificial leather sheet of the invention, the composition is fixed to the sheet surface by the raised fibers, and the composition does not detach from the napped surface even if a certain amount of surface friction acts on the sheet.

The oil tone artificial leather sheet thus obtained can be used not only as a material for shoes, but also as for gloves, bags and clothing.

EXAMPLES

Next, specific examples of this invention will be described. It should be understood that the invention is not limited by these embodiments. All parts in the examples refer to weight unless otherwise specified. The fineness of fibers is calculated from the average value of their cross-sectional area using electron micrographs of fiber cross-sections.

In the examples, appearance and oily hand touch have been assessed by the inventors by the visual appearance and hand touch of the artificial leather sheet surface. These results are expressed by, good: ○, satisfactory: Δ, poor: x.

Manufacturing Example 1

An entangled non-woven fabric was obtained by blending nylon 6 and polyethylene chip in a weight ratio of 50:50, melt spinning by an extruder, spinning a sea-island fiber comprising polyethylene as the sea component and nylon-6 as the island component, drawing, crimping and cutting to produced short fibers of 4 denier and 51 mm length, forming a cross-lap with a webber, and performing needle punching at 700 punches/cm$^2$ using a needle puncher. This non-woven fabric was impregnated with a dimethylformamide solution of a polyurethane resin, i.e., a polymer diol of average molecular weight 2,000 comprising poly-3-methylpentaneadipate diol and polyethylene glycol as a soft segment, and subjected, to wet coagulation. Polyethylene, which is the sea component of the fiber, was then extracted with perchloroethylene, and a substrate was obtained having a density of 450 g/m$^2$, thickness of 1.3 mm, and a polyurethane resin to fiber ratio of 63/37. The fineness of nylon microfine fiber in this substrate was an average of 0.006 denier. One surface of the substrate was buffed with sandpaper to give a sheet having a napped surface comprising nylon microfine fibers. This sheet was dyed under the following conditions using a Circular dyeing machine so as to obtain a brown, napped artificial leather sheet.

| Dyeing conditions | | | |
|---|---|---|---|
| Dye | Lanacron Brown, | S-GR, | 5% owf |
| | Irgalan Yellow | GRL, | 2% owf |
| Bath ratio: | 1:30 | | |
| Dyeing temperature: | 90° C. | | |

Example 1

A supporting polymer was prepared using a hydrogenation product of a triblock copolymer comprising styrene-(isoprene/butadiene)-styrene of average molecular weight 290,000 (SEPTON 4055: manufactured by Kuraray Co., Ltd. hydrogen addition proportion 98%, weight increase after leaving for 24 hours in the following oily substance was 1600%). Paraffin oil (PW-90: manufactured by Idemitsu Kosan Co., Ltd., viscosity 140 mPa·s at 30° C.) was used as the oily substance. The supporting polymer and the paraffin oil (weight ratio of paraffin oil: supporting polymer is 5:1) were dissolved in a toluene to prepare a toluene solution (block copolymer concentration =3%). The toluene solution containing the supporting polymer and the oily substance was applied by a 55 mesh gravure roll at a coating amount (total amount of the supporting polymer and the oily substance) of 6 g/m$^2$ to the napped surface of the artificial leather sheet obtained in the above Manufacturing Example 1, and the product was dried to evaporate toluene.

The artificial leather sheet obtained had a moist, elegant appearance and hand touch. When this artificial leather sheet was pulled, the pulled part whitened, and when the pulling was stopped, the original tone returned. Hence, it was extremely similar to oil tone natural leather.

Example 2

The same procedure was followed to obtain an artificial leather sheet as in Example 1, except that the blending amount of the oily substance was 12 times relative to the hydrogenation product of the block copolymer.

The artificial leather sheet obtained had a moist, elegant appearance and hand touch as in Example 1. When this artificial leather sheet was pulled, the pulled part whitened, and when the pulling was stopped, the original tone returned. Hence, it was extremely similar to oil tone natural leather.

Example 3

A supporting polymer was prepared using a hydrogenation product of a triblock copolymer comprising styrene-(isoprene)-styrene of average molecular weight 80,000 (SEPTON; 2007: manufactured by Kuraray Co., Ltd. hydrogen addition proportion 98%, weight increase after leaving for 24 hours in the following oily substance was 1600%). Paraffin oil (PW-380: manufactured by Idemitsu Kosan Co., Ltd., viscosity 600 mPa·s at 30° C.) was used as the oily substance. The supporting polymer and the paraffin oil (weight ratio of paraffin oil: supporting polymer is 8:1) were dissolved in a toluene to prepare a toluene solution (block copolymer concentration =1%). The toluene solution containing the supporting polymer and the oily substance was applied at a coating amount (total amount of the supporting polymer and the oily substance) of 4 g/m$^2$ to the napped artificial leather sheet surface obtained in the above Manufacturing Example 1, and the product was dried for 20 minutes in a drier at 70° C. to produce an oil tone artificial leather sheet.

The artificial leather sheet obtained had a moist, elegant appearance and hand touch. When this artificial leather sheet was pulled, the pulled part whitened, and when the pulling was stopped, the original tone returned. Hence, it was extremely similar to oil tone natural leather.

Example 4

A supporting polymer was prepared using EPR (EP961SP, manufactured by JSR Corporation, weight addition after leaving for 24 hours in the following oily substance was 1500%, side chain hydrocarbon group content was 20 mol %). Paraffin oil (PW-380: manufactured by Idemitsu Kosan Co., Ltd., viscosity 600 mPa-s at 30° C.) was used as the oily substance. The supporting polymer and the paraffin oil (weight ratio of paraffin oil supporting polymer is 2:1) were dissolved in a toluene to prepare a toluene solution (block copolymer concentration =1%). The toluene solution containing the supporting polymer and the oily substance was applied at a total coating amount of 4 g/m$^2$ to the napped artificial leather sheet surface obtained in the above Manufacturing Example 1, and the product was dried for 20 minutes in a drier at 70° C. to produce an oil tone artificial leather sheet.

The artificial leather sheet obtained had a moist, elegant appearance and hand touch. When this artificial leather sheet was pulled, the pulled part whitened, and when the pulling was stopped, the original tone returned. Hence, it was extremely similar to oil tone natural leather.

Comparative Example 1

An artificial leather sheet was obtained exactly as in Example 1, except that the oily substance was not used. The artificial leather sheet obtained was rubber-like, had a dry touch, did not have an oily hand touch, and did not change in color even when pulled.

Comparative Example 2

An artificial leather sheet was obtained exactly as in Example 1, except that the supporting polymer was not used. The artificial leather sheet obtained had a smooth touch, had none of the slippery hand touch of oil tone, and when touched, oil was left adhering to the hand. The hand touch also changed with elapsed time immediately after coating, and the oil adhesion amount decreased with time.

The performance of the artificial leather sheets obtained in the aforesaid examples and comparative examples is shown in Table 1.

TABLE 1

| | Example 1 | Example 2 | Example 3 | Example 4 | Comparative Example 1 | Comparative Example 2 |
|---|---|---|---|---|---|---|
| Napped artificial leather sheet | Manufacturing Example 1 | Manufacturing Example 1 | Manufacturing Example 1 | Manufacturing Example 1 | Manufacturing Example 1 | Manufacturing Example 1 |
| Supporting polymer (1) | SEPTON 4055 | SEPTON 4055 | SEPTON 2007 | EP961SP | SEPTON 4055 | — |
| Oily substance (2) | PW-90 | PW-90 | PW-380 | PW-380 | — | PW-90 |
| (2)/(1) | 5 | 12 | 8 | 2 | 0 | — |
| Oily substance viscosity (mPa · s) (30° C.) | 140 | 140 | 600 | 600 | — | 140 |
| Appearance | ◎ | ◎ | ◎ | ◎ | X | ○ |
| Oily hand touch | ◎ | ◎ | ◎ | ○ | X | X |
| Change with time | None | None | None | None | None | X |

Advantages of the Invention

The oil tone artificial leather sheet of this invention preferably comprises a blend of (1): at least one type of elastomer chosen from a group comprising an ethylene polymer having hydrocarbon groups with 18 carbon atoms in side chains, and 5–60 mol % of units having side chains relative to the ethylene unit forming the main chain, a block copolymer comprising an ethylene polymer block, and a block copolymer comprising a polymer block A comprising a vinyl aromatic compound and a polymer block B comprising a conjugated diene, or a hydrogenation product thereof, and (2): an oily substance, the weight ratio of (1) and (2) being (2)/(1)=1–20. This blend is coated on the nap surface of a napped artificial leather sheet incorporating polyurethane in a non-woven fabric comprising microfine fibers not exceeding 0.3 denier on which fibers are present. As a result, a product is obtained having a high-class oil tone appearance, a soft hand touch and a touch equivalent to that of natural leather, this product being useful when applied to the manufacture of shoes, etc.

Obviously, numerous modifications and variations of the present invention are possible in light of the above teachings. It is therefore to be understood that within the scope of the appended claims, the invention may be practiced otherwise than as specifically described herein.

This application is based on Japanese Patent Application Serial No. 235341, filed on Aug. 23, 1999, and incorporated herein by reference in its entirety.

What is claimed is:

1. An oil tone artificial leather sheet, comprising:

a napped sheet comprising a non-woven fabric of microfine fibers and a polyurethane in the non-woven fabric, wherein raised fibers comprising the microfine fibers are present in at least a portion of at least one surface of the sheet and form the nap surface; and a blend of an oily substance having a viscosity of 50 to 10,000 mPa·s at 30° C. and a supporting polymer on at least a portion of the nap surface of the napped sheet, wherein the supporting polymer is (a) a block copolymer comprising an ethylene polymer or ethylene polymer block having hydrocarbon groups with 1–8 carbon atoms in side chains, and 5–60% of units having side chains relative to the ethylene unit forming the main chain, or (b) a block copolymer comprising a polymer block A comprising a vinyl aromatic compound and a polymer block B comprising a conjugated diene, or a hydrogenation product thereof.

2. The oil tone leather sheet of claim 1, wherein the supporting polymer is an olefinic elastomer.

3. The oil tone leather sheet of claim 1, wherein the supporting polymer is a vinyl aromatic elastomer.

4. The oil tone artificial leather sheet of claim 1, wherein the oily substance comprises at least one member selected from the group consisting of paraffin type process oils, naphthene type process oils, white oil, mineral oil, oligomers of ethylene and alpha-olefins, paraffin wax, flow paraffins, silicone oil, vegetable oil and aromatic oils.

5. The oil tone artificial leather sheet of claim 1, wherein the oily substance comprises a paraffin process oil.

6. The oil tone artificial leather sheet of claim 1, wherein the microfine fibers do not exceed 0.3 denier.

7. The oil tone artificial leather sheet of claim 1, wherein the microfine fibers are comprised of a resin selected from the group consisting of aromatic polyesters, polyamides and polyolefins.

8. The oil tone artificial leather sheet of claim 1, wherein the polyurethane is derived from a polymer selected from the group consisting of polyester diols, polylactone diols, polycarbonate diols, polyether diols and polyether ester diols, which has a number average molecular weight of 500 to 5,000.

9. The oil tone artificial leather sheet of claim 1, wherein the weight ratio of the microfine fibers to the polyurethane is 30/70 to 80/20.

10. A method of making the oil tone artificial leather sheet of claim 1, comprising coating and/or impregnating the nap sheet with a composition comprising the oily substance and the supporting polymer.

11. The method of claim 10, wherein the nap sheet is coated and/or impregnated with 1 to 50 g of the composition per 1 $m^2$ of sheet surface.

12. The oil tone leather sheet of claim 1, wherein the weight ratio of the oily substance to the supporting polymer is 1:1 to 20:1.

* * * * *